US009700106B2

(12) United States Patent
Kojima

(10) Patent No.: US 9,700,106 B2
(45) Date of Patent: Jul. 11, 2017

(54) SLIDE FASTENER

(71) Applicant: YKK Corporation, Tokyo (JP)

(72) Inventor: Masayoshi Kojima, Toyoma (JP)

(73) Assignee: YKK Corporation (JP)

( * ) Notice: Subject to any disclaimer, the term of this patent is extended or adjusted under 35 U.S.C. 154(b) by 185 days.

(21) Appl. No.: 14/020,954

(22) Filed: Sep. 9, 2013

(65) Prior Publication Data

US 2014/0068899 A1 Mar. 13, 2014

(30) Foreign Application Priority Data

Sep. 10, 2012 (JP) ..... 2012-005518 U

(51) Int. Cl.
*A44B 19/26* (2006.01)
*A44B 19/34* (2006.01)

(52) U.S. Cl.
CPC ..... *A44B 19/26* (2013.01); *A44B 19/34* (2013.01); *A44B 19/346* (2013.01); *Y10T 24/2532* (2015.01)

(58) Field of Classification Search
CPC ..... A44B 19/26; A44B 19/346; A44B 19/34; Y10T 24/2532
USPC ..... 24/381, 389, 432
See application file for complete search history.

(56) References Cited

U.S. PATENT DOCUMENTS 2,251,137 A * 7/1941 Kay ..... 24/432
3,811,915 A * 5/1974 Burrell ..... B41M 3/06 101/490
5,042,117 A * 8/1991 Tsubata ..... 24/381
5,417,249 A * 5/1995 Kato ..... 139/384 B
5,586,369 A * 12/1996 Matsuda et al. ..... 24/392
5,728,460 A * 3/1998 Hirasawa et al. ..... 428/349
6,427,294 B1 * 8/2002 Shibaike et al. ..... 24/398
7,231,697 B2 * 6/2007 Takamatsu et al. ..... 24/436

(Continued)

FOREIGN PATENT DOCUMENTS

CN 102256805 A 11/2011
JP 61-239983 A 10/1986
WO 2009/068848 A2 6/2009

OTHER PUBLICATIONS

European Search Report, European Patent Application No. 13183425.1, mailed Nov. 28, 2013.

(Continued)

*Primary Examiner* — Robert J Sandy
*Assistant Examiner* — Louis Mercado
(74) *Attorney, Agent, or Firm* — Kilpatrick Townsend & Stockton LLP

(57) ABSTRACT

There is provided a slide fastener. A pair of fastener tapes is formed with a pattern on a front surface thereof. A pair of fastener element rows is respectively provided along opposing side edge portions of the pair of fastener tapes. A slider is configured to engage and disengage the pair of fastener element rows. A film member is fixed to the front surface of the pair of fastener tapes such that the pattern is visible. The film member is provided with a concave-convex shape on a surface thereof. The pattern of the fastener tapes and the concave-convex shape of the film member are respectively related to a pattern and a concave-convex shape of one of (a) animal skin, (b) a woven or knitting which is formed by performing weaving or knitting of fibers or bamboo strips, (c) woodgrain, and (d) stone pitching.

4 Claims, 7 Drawing Sheets

(56) References Cited

U.S. PATENT DOCUMENTS

| | | | | |
|---|---|---|---|---|
| 7,386,921 | B2 * | 6/2008 | Kojima | 24/427 |
| 7,426,772 | B2 * | 9/2008 | Himi et al. | 24/414 |
| 8,539,650 | B2 * | 9/2013 | Kojima et al. | 24/410 |
| 8,667,652 | B2 * | 3/2014 | Thomas et al. | 24/389 |
| 2004/0111842 | A1 * | 6/2004 | Imai | 24/381 |
| 2004/0237266 | A1 * | 12/2004 | Wang | 24/389 |
| 2011/0268937 | A1 | 11/2011 | Schacht et al. | |
| 2012/0015107 | A1 | 1/2012 | Schacht et al. | |

OTHER PUBLICATIONS

Office Action, Chinese Patent Application No. 201310415083.6, mailed May 12, 2015.

* cited by examiner

SLIDE FASTENER

CROSS-REFERENCE TO RELATED APPLICATIONS

This application is based on and claims priority from Japanese Utility Model Application No. 2012-005518 filed on Sep. 10, 2012 and the disclosure thereof, including specification, drawings and claims is incorporated herein by reference in its entirety.

TECHNICAL FIELD

The present invention relates to a slide fastener, and more particularly, to a slide fastener in which a front surface of fastener tapes is provided with a decoration such as a python print pattern.

BACKGROUND

In the related art, a python print pattern is printed on a front surface of fastener tapes and a transparent film is bonded to the front surface on which the pattern is printed. As shown in FIG. 6, Patent Document 1 discloses a slide fastener 100 in which a pattern 102 is printed on a front surface of fastener tapes 101 with ink jet printing, and then the front surface is coated with transparent films 103. In the slide fastener 100 shown in FIG. 7, a groove-shaped concaves and convexes 104 are formed on the surface of the transparent film 103 in order to prevent slip or improve decorative quality.

Patent Document 1: WO 2009/068848 A2

In the fastener tapes having the python print pattern, there is a problem in that it is difficult to produce a python-texture. Patent Document 1 discloses a slide fastener in which the pattern is printed on the front surface of the fastener tapes and then the transparent film is coated thereon, and a slide fastener in which a concave-convex pattern consisting of a plurality of grooves is provided. However, Patent Document 1 does not provide a solution for the foregoing problem.

SUMMARY

It is therefore an object of the present invention to provide a slide fastener in which fastener tapes are provided with a decoration which has a texture similar to an animal skin such as python pattern.

The object of the present invention is achieved by the following configurations.

(1) A slide fastener comprising: a pair of fastener tapes formed with a pattern on a front surface thereof; a pair of fastener element rows respectively provided along opposing side edge portions of the pair of fastener tapes; a slider configured to engage and disengage the pair of fastener element rows; and a film member fixed to the front surface of the pair of fastener tapes such that the pattern is visible, wherein the film member is provided with a concave-convex shape on a surface thereof, and wherein the pattern of the fastener tapes and the concave-convex shape of the film member are respectively related to a pattern and a concave-convex shape of one of (a) animal skin, (b) a woven or knitting which is formed by performing weaving or knitting of fibers or bamboo strips, (c) woodgrain, and (d) stone pitching.

(2) The slide fastener according to (1), wherein each of the pattern of the fastener tapes and the concave-convex shape of the film member is provided with a plurality of pattern units each of which having a substantially rectangle shape with diagonal lines having different lengths, and wherein each of the pattern of the fastener tapes and the concave-convex shape of the film member is continuously formed along a longitudinal direction of the fastener tapes in a state where a longer one of the diagonal lines is oriented along the longitudinal direction of the fastener tapes.

(3) A slide fastener comprising: a pair of fastener tapes formed with a pattern on a front surface thereof; a pair of fastener element rows respectively provided along opposing side edge portions of the pair of fastener tapes; a slider configured to engage and disengage the pair of fastener element rows; and a film member fixed to the front surface of the pair of fastener tapes such that the pattern is visible, wherein the film member is provided with a concave-convex shape on a surface thereof, wherein each of the pattern of the fastener tapes and the concave-convex shape of the film member is provided with a plurality of pattern units each of which having a substantially rectangle shape with diagonal lines having different lengths, and wherein each of the pattern of the fastener tapes and the concave-convex shape of the film member is continuously formed along a longitudinal direction of the fastener tapes in a state where a longer one of the diagonal lines is oriented along the longitudinal direction of the fastener tapes.

According to the above configuration, the fastener tapes are provided with the pattern on the front surface thereof, the film member provided with the concave-convex shape on the surface thereof is fixed to the fastener tapes such that the pattern of the fastener tapes is visible, and the pattern of the fastener tapes and the concave-convex shape of the film member are respectively related to the pattern and the concave-convex shape of one of animal skin, a woven or knitting, woodgrain and stone pitching. Consequently, it is possible to give a texture unique to the pattern formed on the fastener tapes in the decoration, thereby improving the product value of the slide fastener.

In addition, according to the above configuration, each of the pattern of the fastener tapes and the concave-convex shape of the film member is provided with a plurality of pattern units each of which having a substantially rectangle shape with diagonal lines having different lengths and each of the pattern of the fastener tapes and the concave-convex shape of the fastener tapes is continuously formed along the longitudinal direction of the fastener tapes in the state where the longer diagonal line is oriented along the longitudinal direction of the fastener tapes. Consequently, it is possible to produce the slide fastener with a decoration having the texture similar to the python skin, thereby improving product value.

DETAILED DESCRIPTION OF THE EMBODIMENTS

Hereinafter, embodiments of a slide fastener according to the present invention will be described in detail with reference to the accompanying drawings. In the following description, as for fastener tapes, a front side refers to a side at which a pattern provided on the fastener tapes is disposed and a pull-tab for performing a sliding manipulation of a slider is disposed, a back side refers to a side which is opposite to the front side, and at which the pattern of the fastener tapes is not disposed, an upper side refers to a side toward which the slider is slid so as to engage coil-shaped fastener elements which will be described later, a lower side refers to a side toward which the slider is slid so as to disengage the coil-shaped fastener elements, a left side refers to a left side when the front side of the fastener tapes is viewed from the front, and a right side refers to a right side when the front side of the fastener tapes is viewed from the front. In addition, a right and left direction of the fastener tapes is also referred to as a width direction, and an upward and downward direction of the fastener tapes is also referred to as a longitudinal direction. Herein, the pattern refers to a pattern that is formed by coloring the front surface of the fastener tapes with two or more dyes.

Figure 1:
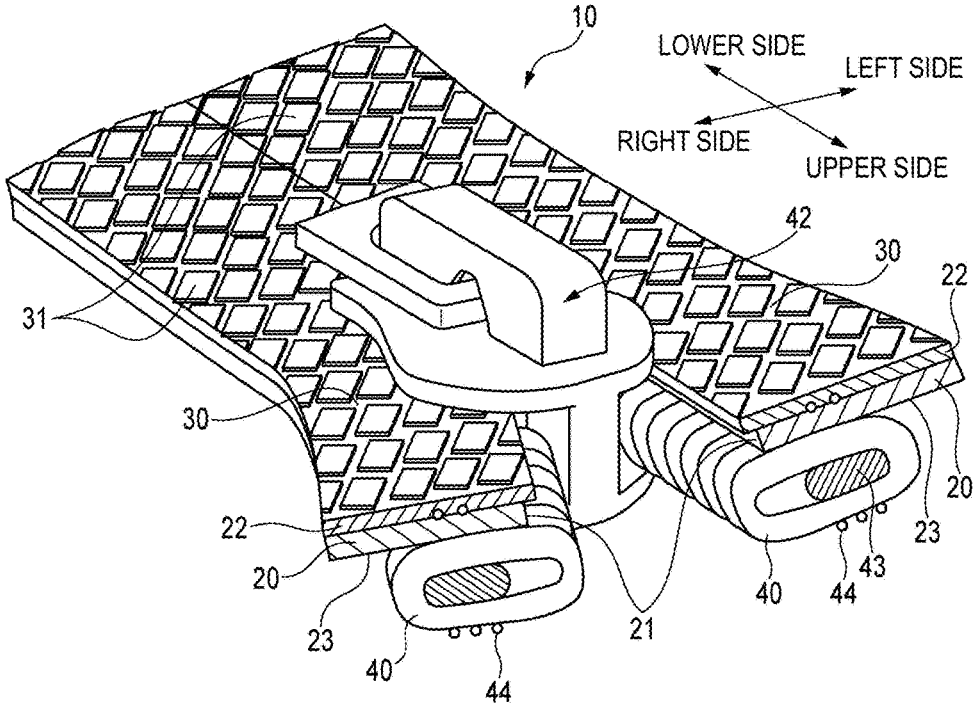
FIG. 1 is a perspective view of a slide fastener according to the present invention.

As shown in FIG. 1, the slide fastener 10 according to this embodiment includes a pair of right and left fastener tapes 20, a film member 30 fixed to the front surface of the pair of right and left fastener tapes 20, a pair of right and left coil-shaped fastener element rows 40 which are respectively provided along opposing tape side edge portions 21 of the pair of right and left fastener tapes 20, and a slider 42 attached to the right and left coil-shaped fastener element rows 40 and configured to engage and disengage the right and left coil-shaped fastener element rows 40. In addition, top end stops (not shown) and bottom end stops (not shown) are provided on the upper and lower end portions of the right and left coil-shaped fastener element rows 40. The film member 30 is transparent or semitransparent such that the pattern of the front surface of the fastener tapes 20 can be viewed through the film member 30. In addition, the film member 30 is not limited to the colorless and transparent members, but can be colored.

When the slider is moved upward and downward, the pair of right and left rows 40 are engaged with and disengaged from each other. The downward sliding of the slider 42 is limited by the bottom end stops and the upward sliding of the slider is limited by the top end stops so that the slider 42 does not slip away from the coil-shaped fastener element rows 40.

The pair of right and left fastener tapes 20 include a pair of right and left tape members which continuously extend along the longitudinal direction (the upward and downward direction), have the same width, and formed by weaving. From the point of view of the process of printing the pattern or the outer appearance, it is preferable that the woven be planar. It is also preferable that the weaving be a 1/1 plain weave, a 2/2 plain weave, a twill weave, or the like, in which the same texture is woven over almost the entire area of the tapes. The tape members may be knitted.

On the front surface of the pair of fastener tapes 20, a pattern is formed by printing such as ink jet printing. That is, the pattern is formed on the front side of the tape members. The pattern is continuously formed over the entire surfaces of the pair of right and left fastener tapes 20 across the tape side edge portions 21. Consequently, it is possible to prevent the continuity of the pattern from being interrupted at a boundary between the right and left fastener tapes 20. Means for forming the pattern is not limited to the ink jet printing. For example, it is possible to form the pattern by printing the pattern on a transfer film by ink jet printing, placing the transfer film on the front surface of the tape members, and then heating the transfer film so as to transfer the pattern on the transfer film to the tape members.

Figure 2A:
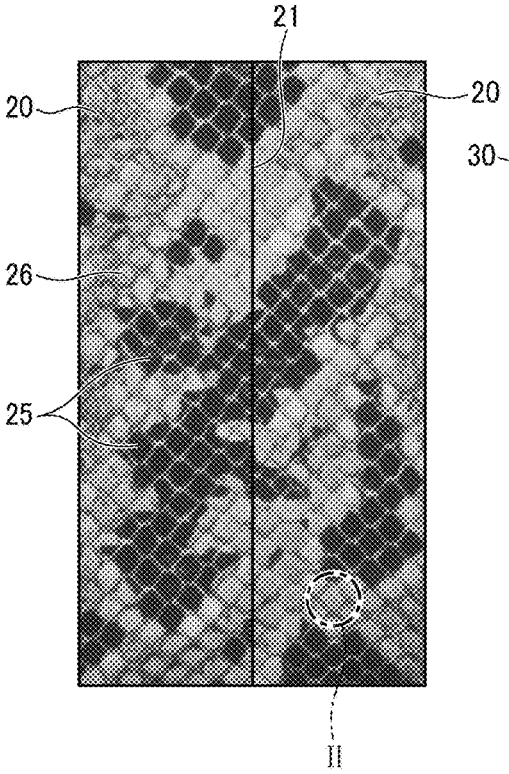
FIG. 2A is a top plan view of a python print pattern as an example of the pattern provided on the fastener tapes.
Figure 2B:
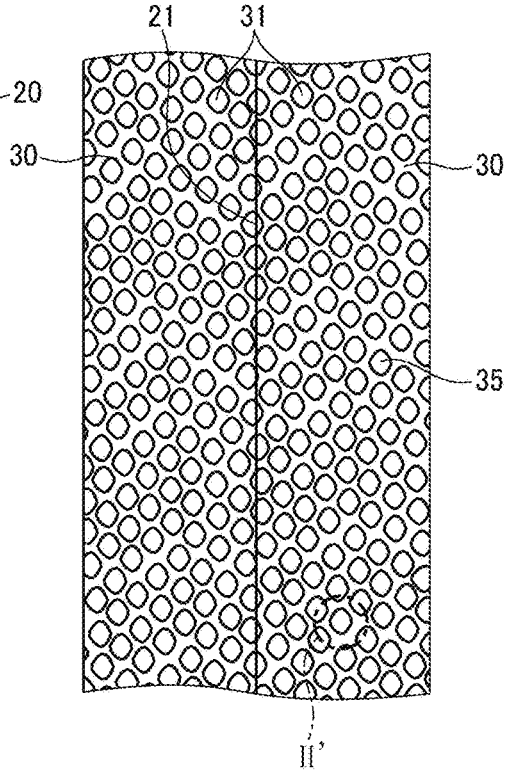
FIG. 2B is a top plan view of the film member having a concave-convex shape corresponding to the python print pattern.
Figure 2C:
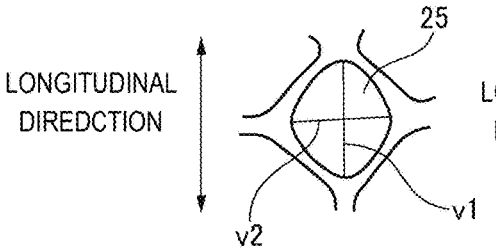
FIG. 2C is an enlarged view of part II in FIG. 2A.

According to this embodiment, as shown in FIG. 2A, the fastener tapes 20 are provided with a python print pattern 26. Herein, "python" refers to a snake, and the python print refers to a snake skin print. As shown in FIG. 2C, the python print pattern 26 has dappled color. The python print pattern 26 has a planar shape in which a plurality of pattern units 25 each having a substantially rectangle shape with diagonal lines v1 and v2 having different lengths are continuously formed along the longitudinal direction of the fastener tapes 20 in a state where the longer diagonal line v1 is oriented along the longitudinal direction of the fastener tapes 20. Here, the pattern units 25 of the pattern formed on the tape members constitute the dappled color. In the dappled color, one color is different from the adjacent color, thereby making a discriminable boundary between the one color and the adjacent color. A color surrounded by the boundary is defined as one of the pattern units 25 of the pattern 26.

Figure 2D:
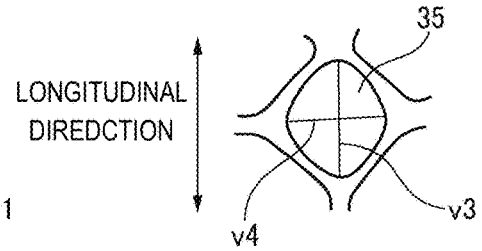
FIG. 2D is an enlarged view of part II' in FIG. 2B.

The film member 30 is a transparent film which is fixed to the front surface 22 (the surface at the side on which the python print pattern 26 is printed) of the pair of right and left fastener tapes 20 by heat fusion, bonding or the like. The film member 30 is provided on the surface thereof with concave-convex shape 31 corresponding to the python print pattern 26. As shown in FIG. 2D, the concave-convex shape 31 is formed by a plurality of pattern units 35 each having a substantially rectangle shape with diagonal lines v3 and v4 having different lengths. The concave-convex shape 31 is continuously formed along the longitudinal direction of the film member 30, i.e. the longitudinal direction of the fastener tapes 20 after fixing the film member 30 to the fastener tapes 20 in a state where the longer diagonal line v3 is oriented along the longitudinal direction of the fastener tapes 20. This is because the skin pattern of an actual python (snake) is arranged along the longitudinal direction extending from the head. Thus, the above arrangement of the pattern makes the fastener tapes 20 provided with the python print more similar to that of the actual python. Here, in the pattern units 35 of the concave-convex shape 31 formed on the film member 30, assuming that a concave portion is provided at a portion of the film member 30, which is most adjacent to the front surface of the tape member, a convex portion protrudes from the concave portion and a boundary is formed between the adjacent convex portions. The convex discriminated by this boundary is defined as one of the pattern units 35 of the concave-convex shape 31.

The orientation of the longer diagonal lines v1 and v3 along the longitudinal direction of the fastener tapes 20 indicates that the longer diagonal lines v1 and v3 are preferably more adjacent to the longitudinal direction of the fastener tapes 20 than the shorter diagonal lines v2 and v4, and includes the case in which the longer diagonal lines v1 and v3 are not completely aligned along the longitudinal direction of the fastener tapes 20. Regarding the description that the concave-convex shape 31 of the film member 30 corresponds to the python print pattern 26 of the fastener tapes 20, the pattern units 25 of the pattern 26 and the pattern units 35 of the concave-convex shape 31 preferably have the above-described common characteristics. This also includes the case in which the unit pattern 25 of the shape 26 is not perfectly identical with the unit pattern 35 of the concave-convex shape 31 in the mutually fixed state. The diagonal lines are defined since the pattern units 25 and 35 are similar to a rhombic shape. Here, while the rhombic shape has round corners, diagonal lines can be drawn by assuming a vertex of each round portion as a corner.

The film member 30 has a multilayer structure in which a resin layer and an adhesive layer are formed on a surface of a release paper (not shown). The film member 30 is pressed against the front surface 22 of the tape members of the fastener tapes 20, and the resin layer and the adhesive layer are peeled off from the release paper and fixed to the front surface 22 of the tape members of the fastener tapes 20. The adhesive layer may be replaced by a heat fusion layer. The heat fusion layer is fused by being heated and is fixed to the front surface of the tape members of the fastener tapes 20.

Such a film member can be manufactured by applying a liquid resin such as polyurethane, polyethylene, polypropylene, polyvinyl chloride on a release paper formed with concaves and convexes of pattern units having a substantially rectangle shape on the surface thereof, solidifying the applied liquid resin, and additionally applying a heat fusion agent or an adhesive on the solidified resin. In this case, when the liquid resin applied on the release paper is solidified, the film member 30 is formed.

The concave-convex shape 31 corresponding to the python print pattern 26 can be produced by pressing a transparent sheet with a roller having the concave-convex shape 31 on the outer circumstance thereof, or by laser machining of irradiating laser beams on a transparent sheet.

The film member 30 can be fixed to the front surface 22 of the fastener tapes 20 having the python print pattern 26 by heat fusion, bonding, or the like, so that the python print pattern 26 can be viewed through the film member 30. Consequently, it is possible to realize the three-dimensional texture having concaves and convexes on the surface and being similar to the real python skin.

As shown in FIG. 1, the coil-shaped fastener element rows 40 are formed by winding a monofilament of, for example, polyamide or polyester, into the shape of a coil. A core string 43 is inserted into each of the coil-shaped fastener element rows 40 so as to extend through, and the coil-shaped fastener element rows 40 are fixed to the back surface 23 (the side on which the pattern 26 is not printed) of the fastener tapes 20 along the tape side edge portions 21 by being sewn thereto with sewing thread 44. Alternatively, the coil-shaped fastener element rows 40 are fixed to the tape members of the fastener tapes 20 by weaving or knitting by winding a monofilament into the shape of a coil concurrently with knitting/weaving of the tape members of the fastener tapes 20.

In the slide fastener 10 according to this embodiment, the pair of right and left coil-shaped fastener element rows 40 are sewn to the back surface 23 of the fastener tapes 20 along the tape side edge portions 21 of the pair of right and left fastener tapes 20, and in the state in which the pair of right and left coil-shaped fastener element rows 40 are engaged with each other, the python print pattern 26 is concurrently printed on the entire area of the front surface 22 of the pair of fastener tapes 20.

In sequence, the slide fastener 10 is manufactured by fixing one wide sheet of film member 30 having the same width as the pair of right and left fastener tapes 20 to the top of the python print pattern 26 on the front surface 22 of the pair of fastener tapes 20 by heat fusion, bonding, or the like, and then cutting the film member 30 along the tape side edge portions 21 in the middle between the tape side edge portions 21 of the pair of fastener tapes 20.

As described above, the slide fastener 10 according to this embodiment is provided with the fastener tapes 20 which has the pattern 26, 27 on the front surface 22 and the film member 30 which has the concave-convex shape 31, 33 on the surface and is fixed to the fastener tapes 20 such that the pattern 26, 27 of the fastener tapes 20 can be viewed. The pattern 26, 27 of the fastener tapes 20 and the concave-convex shape 31, 33 of the film member 30 are respectively related to the pattern and the concave-convex shape of the python skin. Accordingly, it is possible to give the texture unique to the python print pattern 26 on the fastener tapes 20 in the decoration, thereby improving the product value of the slide fastener 10.

In addition, in the slide fastener 10 according to this embodiment, each of the pattern 26 of the fastener tapes 20 and the concave-convex shape 31 of the film member 30 is provided with a plurality of pattern units 25, 35 each of which having a substantially rectangle shape with diagonal lines v1, v2, v3, v4 having different lengths and each of the pattern 26 and the concave-convex shape 31 can be continuously formed along the longitudinal direction of the fastener tapes 20 in the state where the longer diagonal line v1, v3 of the diagonal lines is oriented along the longitudinal direction of the fastener tapes 20. Accordingly, it is possible to produce the slide fastener 10 with a decoration having the texture similar to the python skin, thereby improving the product value of the slide fastener 10.

The present invention is not limited to the foregoing embodiment but can be suitably modified without departing from the scope of the present invention. Although the foregoing embodiment has been described with respect to the python pattern, this is not restrictive. For instance, the present invention can have any pattern and concave-convex shape of animal skin such as a crocodile pattern and an ostrich pattern.

Figure 3A:
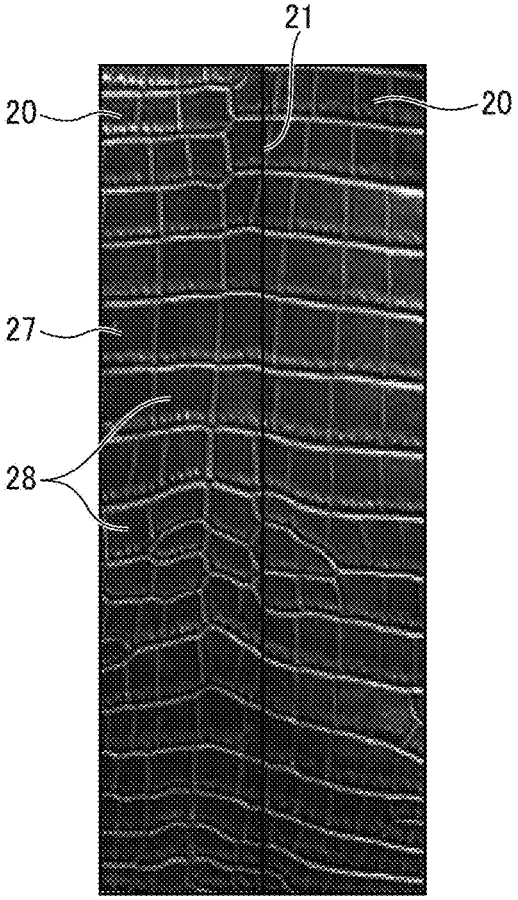
FIG. 3A is a top plan view of a crocodile print pattern as another example of the pattern provided on the fastener tapes.
Figure 3B:
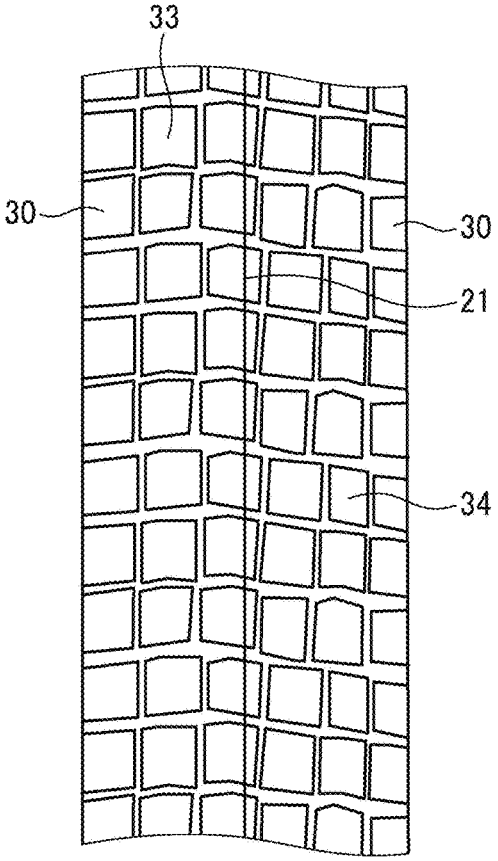
FIG. 3B is a top plan view of the film member having a concave-convex shape corresponding to the crocodile print pattern.

Specifically, FIG. 3A shows a crocodile pattern as another example. As shown in FIG. 3A, in a crocodile print pattern 27, a plurality of pattern units 28 each having a substantially rectangle shape are continuously formed over the entire area of the front surface 22 of the pair of right and left fastener tapes 20. As shown in FIG. 3B, the film member 30 is formed with a concave-convex shape 33 formed by a plurality of pattern units 34 each having a substantially rectangle shape and corresponding to the crocodile print pattern 27.

Accordingly, the film member 30 can be fixed to the front surface 22 of the fastener tapes 20 having the crocodile print pattern 27 by heat fusion, bonding, or the like, so that the crocodile print pattern 27 formed on the fastener tapes 20 can be viewed through the film member 30. In addition, since the concaves and convexes are formed on the surface, it is possible to give the three-dimensional texture similar to the real crocodile skin.

Figure 4A:
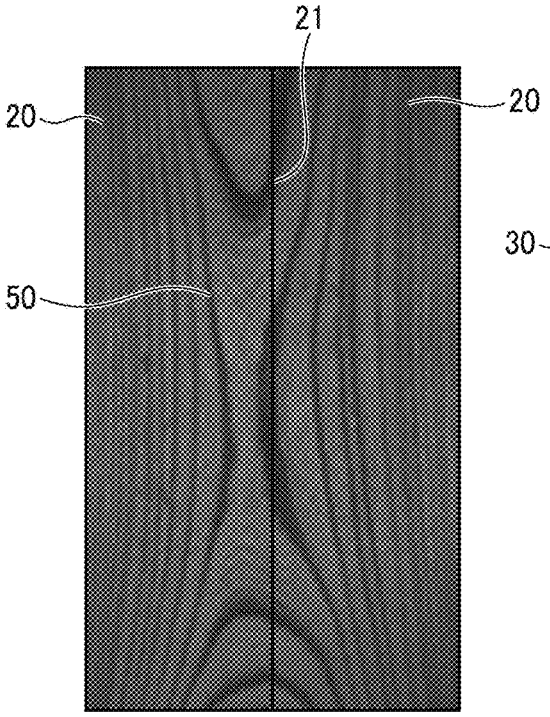
FIG. 4A is a top plan view of a woodgrain pattern as another example of the pattern provided on the fastener tapes.
Figure 4B:
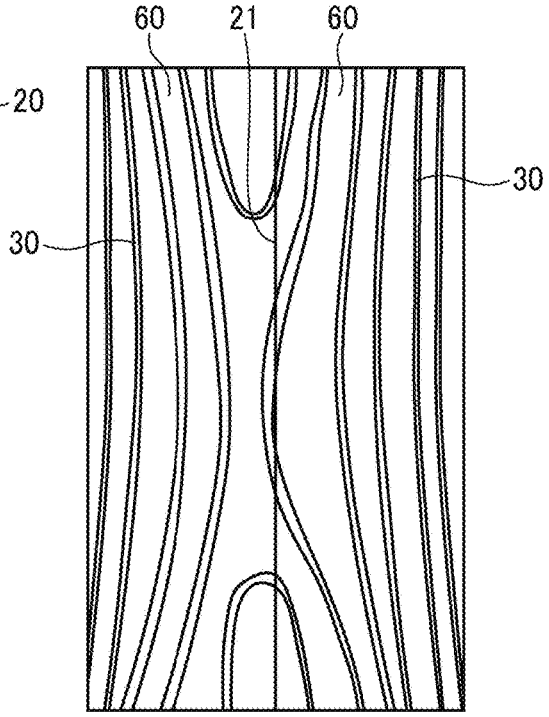
FIG. 4B is a top plan view of the film member having a concave-convex shape corresponding to the woodgrain pattern.

The pattern is not limited to the animal skin but may include any textile pattern that is produced by printing the front surface of woven tape members with a pattern formed when a fiber is woven-knitted by plain weaving or twill weaving. In addition, a pattern that is produced when knitting bamboo strips can be printed on the front surface of the tape members, and a concave-convex shape corresponding to the pattern can be formed on the surface of the film member. In addition, as shown in FIGS. 4A and 4B, a woodgrain pattern 50 is attached to the front surface of the tape members, the film member 30 is attached to the front surface 22 (the surface at the side on which the woodgrain pattern 50 is printed) of the pair of right and left fastener tapes 20 by heat fusion, bonding, or the like, and a concave-convex shape 60 corresponding to the woodgrain pattern 50 is provided on the surface of the film member 30. In this case, the woodgrain pattern 50 consists of relatively brighter regions and relatively darker regions, and the concave-convex shape 60 is produced by forming the relatively brighter regions as concaves and the relatively darker regions as convexes.

Figure 5A:
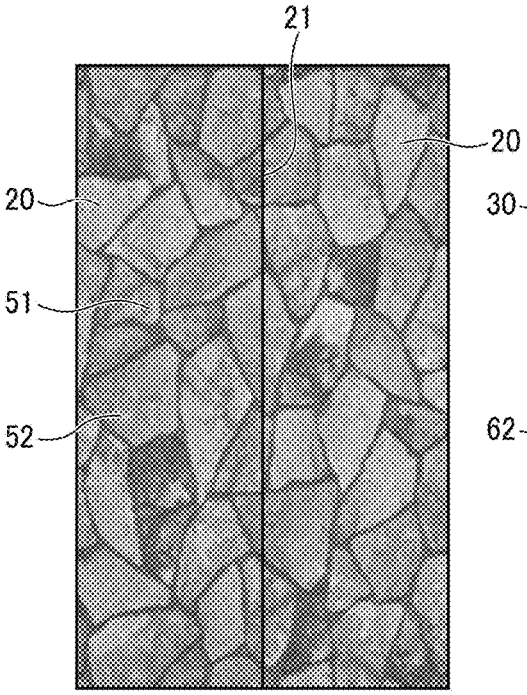
FIG. 5A is a top plan view of a stone pitching pattern as another example of the pattern provided on the fastener tapes.
Figure 5B:
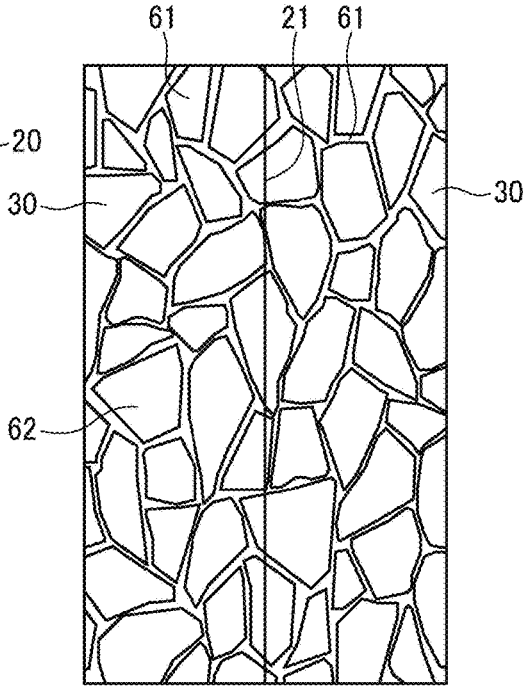
FIG. 5B is a top plan view of the film member having a concave-convex shape corresponding to the stone pitching pattern.
Figure 6:
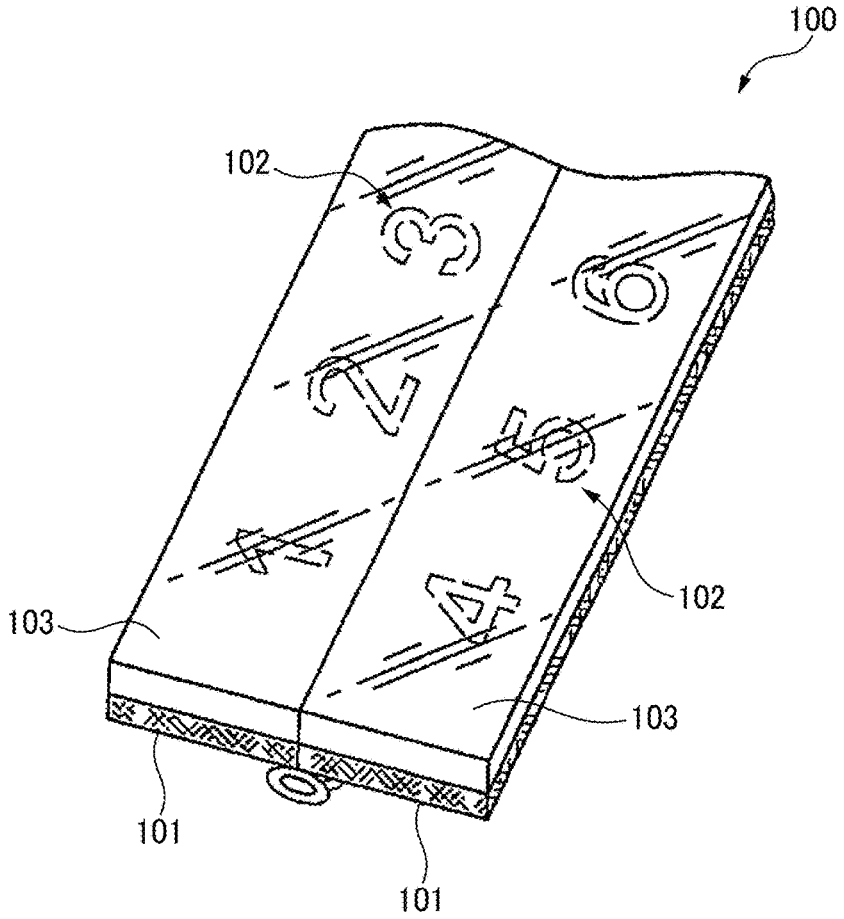
FIG.6 Prior Art
FIG. 6 is a perspective view of a slide fastener of the related art.
Figure 7:
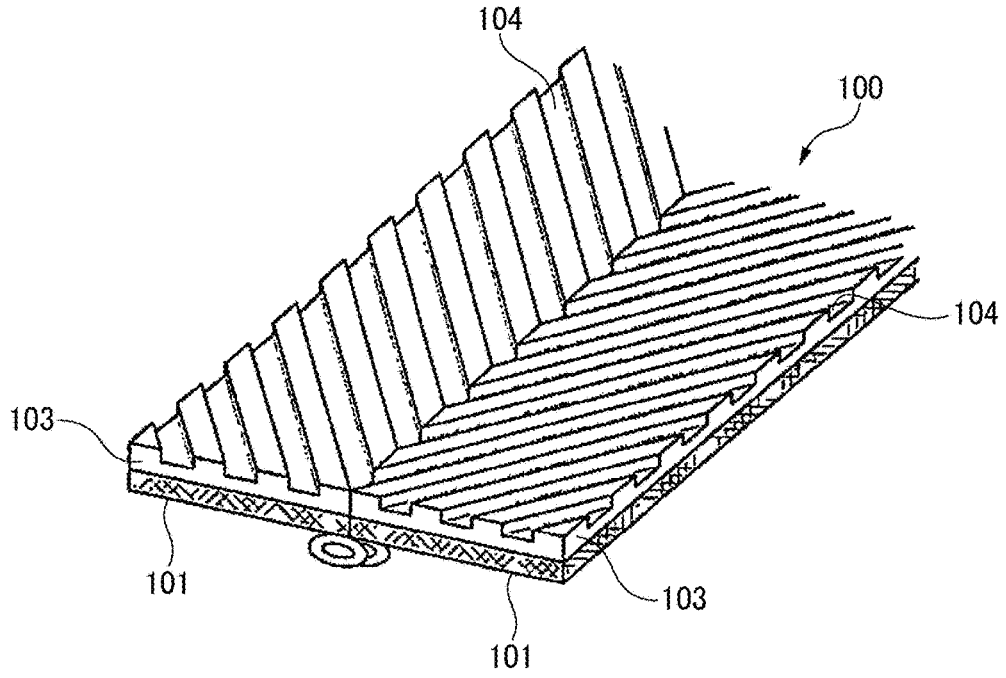
FIG.7 Prior Art
FIG. 7 is a perspective view of another slide fastener of the related art.

In addition, as shown in FIGS. 5A and 5B, a stone pitching pattern 51 is attached to the front surface of the taper members, the film member 30 is attached to the front surface 22 (the surface at the side on which the stone pitching shape 51 is printed) by heat fusion, bonding, or the like, and a concave-convex shape 61 corresponding to the stone pitching pattern 51 is provided on the surface of the film member 30. Here, the stone pitching pattern 51 refers to the pattern in which a plurality of pieces of stone is arranged so as to fill up the gaps. A portion corresponding to each piece of stone is a pattern unit 52 of the stone pitching pattern, and in the concaves and convexes corresponding to the stone pitching pattern, a convex corresponding to one piece of stone is a pattern unit 62 of the concave-convex shape. In addition, the stone pitching pattern can also have a shape in which pieces of stone having the rectangular shape are arranged, in addition to the shape shown in FIGS. 5A and 5B. In this case, the concave-convex shape is also rectangular.

In addition, in the slide fastener 10 according to this embodiment, the pattern and the concave-convex shape are not limited to the animal skin but may be related to the shape of a texture that is formed by woven-knitting. That is, the pattern and the concave-convex shape can be related to the pattern and concave-convex shape of a desired object, thereby producing a slide fastener having a decoration, the texture of which is the same as the real object.

What is claimed is:

1. A slide fastener comprising:

a pair of fastener tapes formed with a pattern on a front surface thereof, wherein the pattern includes a plurality of pattern units each pattern unit having a substantially rectangular shape with diagonals of each pattern unit have different lengths and the pattern is continuously formed along a longitudinal direction of the fastener tapes with a longer one of the diagonals oriented along the longitudinal direction of the fastener tapes;

a pair of fastener element rows respectively provided along opposing side edge portions of the pair of fastener tapes;

a slider configured to engage and disengage the pair of fastener element rows; and a film member fixed to the front surface of the pair of fastener tapes such that the pattern is visible, wherein the film member is provided with a concave-convex shape on a surface thereof, wherein the concave-convex shape includes a plurality of pattern units corresponding to the pattern units of the fastener tapes.

2. The slide fastener according to claim 1, wherein the pattern of the fastener tapes includes a discriminable boundary between one color and an adjacent color and the one color surrounded by the boundary is defined as one of the pattern units.

3. The slide fastener according to claim 2, wherein the pattern of the fastener tapes has dappled color.

4. The slide fastener according to claim 3, wherein the concave-convex shape of the film member has a plurality of concave portions and a plurality of convex portions which protrude from the concave portions, and wherein adjacent convex portions are discriminated by a boundary between the adjacent convex portions and one convex portion surrounded by the boundary is defined as one of the pattern units.

* * * * *